US007946891B2

(12) United States Patent
Peiker

(10) Patent No.: US 7,946,891 B2
(45) Date of Patent: May 24, 2011

(54) ADAPTER FOR A MICRO USB SOCKET OR A MINI USB SOCKET, AND ARRANGEMENT COMPRISING A MOBILE DEVICE, A MOUNT AND AN ADAPTER

(75) Inventor: Andreas Peiker, Friedrichsdorf (DE)

(73) Assignee: Peiker Acustic GmbH & Co. KG, Friedrichsdorf (DE)

( * ) Notice: Subject to any disclaimer, the term of this patent is extended or adjusted under 35 U.S.C. 154(b) by 0 days.

(21) Appl. No.: 12/755,476

(22) Filed: Apr. 7, 2010

(65) Prior Publication Data

US 2010/0261366 A1 Oct. 14, 2010

(30) Foreign Application Priority Data

Apr. 9, 2009 (DE) ..... 10 2009 016 825

(51) Int. Cl.
*H01R 25/00* (2006.01)

(52) U.S. Cl. ..... 439/638

(58) Field of Classification Search ..... 439/638
See application file for complete search history.

(56) References Cited

U.S. PATENT DOCUMENTS

| | | | | |
|---|---|---|---|---|
| 2005/0148232 | A1 | 7/2005 | Hsin | |
| 2008/0274631 | A1* | 11/2008 | Lee et al. | 439/78 |
| 2009/0113103 | A1 | 4/2009 | Chiang | |
| 2009/0277665 | A1* | 11/2009 | Kumamoto et al. | 174/113 R |

FOREIGN PATENT DOCUMENTS

| | | | |
|---|---|---|---|
| DE | 198 35 017 | C2 | 6/2000 |
| DE | 20 2004 010 179 | U1 | 11/2004 |
| DE | 20 2008 014 989 | U1 | 2/2009 |
| DE | 10 2008 015 496 | A1 | 5/2009 |
| WO | 2009/030436 | A1 | 3/2009 |

* cited by examiner

*Primary Examiner* — Phuong K Dinh
(74) *Attorney, Agent, or Firm* — Burr & Brown

(57) ABSTRACT

The invention relates to an adapter for a micro USB socket or a mini USB socket in a mobile device, wherein the adapter includes a micro USB plug contact or a mini USB plug contact. The adapter also includes a contact body which is connected to the micro USB plug contact or to the mini USB plug contact, with the contact body having at least one abutment face for resting against a surface of the mobile device, and with the contact body having at least one contact face with flat contacts.

15 Claims, 6 Drawing Sheets

ADAPTER FOR A MICRO USB SOCKET OR A MINI USB SOCKET, AND ARRANGEMENT COMPRISING A MOBILE DEVICE, A MOUNT AND AN ADAPTER

This application claims the benefit under 35 USC §119(a)-(d) of German Application No. 10 2009 016 825.7 filed Apr. 9, 2009, the entirety of which is incorporated herein by reference.

FIELD OF THE INVENTION

The invention relates to an adapter for a micro USB socket or a mini USB socket, and to an arrangement comprising a mobile device, a mount and an adapter.

BACKGROUND OF THE INVENTION

The prior art discloses adapters in which a micro USB plug contact is converted into a USB-A socket contact, with a gripping body being arranged between the contacts. Furthermore, DE 198 35 017 C2 discloses an arrangement comprising a mobile device, a mount and an adapter, in which arrangement the adapter is in the form of a block with plug contacts which project in the direction of the mount.

SUMMARY OF THE INVENTION

One object of the invention is to provide an adapter which is suitable for use in mobile devices and, in particular, is also suitable for being used with the mobile device when the mobile device is inserted into a mount. A further object of the invention is to provide an arrangement in which the adapter can remain permanently in the mobile device.

In the adapter according to the invention for a micro USB socket or a mini USB socket which is arranged in a mobile device, provision is made to equip the adapter with a contact body, in addition to a micro USB plug contact or mini USB plug contact, the contact body being connected to the USB plug contact, with the contact body having at least one abutment face for resting against a surface of the mobile device, and with the contact body having at least one contact face with flat contacts. An adapter of this type renders possible a contact-making and contact-breaking process between the mobile device and, for example, a mount, it being possible for this process to be carried out virtually without any particular attention since the contact body, together with its contact faces, is designed to be mechanically substantially more robust than the sockets in the mobile device and is insensitive to contamination. Furthermore, the adapter additionally adopts the function of a protective cap for the socket of the mobile device, and therefore has a function even when the adapter is not used as an electrical component. The essence of the invention is an adapter which not only simplifies the process of making contact with a highly sensitive socket in the mobile device, but which also permanently protects the socket of the mobile device, without adversely affecting the usability of the mobile device in the process.

In one embodiment the flat contacts are in the form of strips and/or dots. This results in a smooth contact face with which contact can easily be made and on which, in particular, clothing fabrics do not get caught.

In another embodiment the contact body is formed with at least one gripping recess, and in particular two gripping recesses which are opposite one another. This makes it possible to remove the adapter from the socket of the mobile device with a fingernail, without using a tool.

In another embodiment the contact body is in the form of a covering cap which seals off the mini USB socket of the mobile device from a surrounding area. This prevents, in particular, the ingress of fluff (e.g., lint) which accumulates in the socket of the mobile device and makes the mobile device unusable. It is also possible according to the invention for the abutment face of the body to be of rubberized form or for the abutment face of the body to be covered by a flat sealing ring. This allows the socket of the mobile device to be sealed off in accordance with the provisions of IP54, which are met, for example, by outdoor mobile telephones. Therefore, an outdoor mobile telephone maintains its IP54 classification in spite of the use of the adapter.

In the arrangement according to the invention, which comprises a mobile device with a socket for making contact, a mount and an adapter, the adapter is formed from a plug contact and a contact body which is connected to the plug contact, with the contact body having at least one abutment face for resting against a surface of the mobile device, with the contact body having at least one contact face with flat contacts, and with the contact body forming a covering cap for the socket, the covering cap protecting the socket even when the mobile device is used without the mount. This makes it much easier to make contact with the mobile device in the mount, since the mount does not have to have any contact plugs which have to be inserted into the socket of the mobile device, but instead a contact strip which is arranged in the mount suffices for making contact with the contact face of the adapter. This design also makes it possible to use sprung contacts in the contact strip of the mount, and therefore a contact-connection of higher quality and with less sensitivity to vibration and manufacturing tolerances is possible. After the mobile device is removed from the mount, the adapter also serves as a protective cap for the socket of the mobile device.

The specific embodiments explained above with respect to the adapter analogously apply to the arrangement according to the invention, as well.

For the purposes of the invention, a mobile device is understood to be any electronic device which is suitable for storing and/or interchanging information. In particular, an electronic device is understood to be a mobile telephone or a personal digital assistant (PDA).

For the purposes of the invention, a mount is understood to be both a motor vehicle mount in which the mobile device is fixed in all spatial directions by a fixing means, and also a charger into which the mobile device can be inserted without being fixed.

BRIEF DESCRIPTION OF THE DRAWINGS

Further details of the invention are described with reference to exemplary embodiments which are schematically illustrated in the drawing, in which.

DETAILED DESCRIPTION OF THE INVENTION

Figure 1:
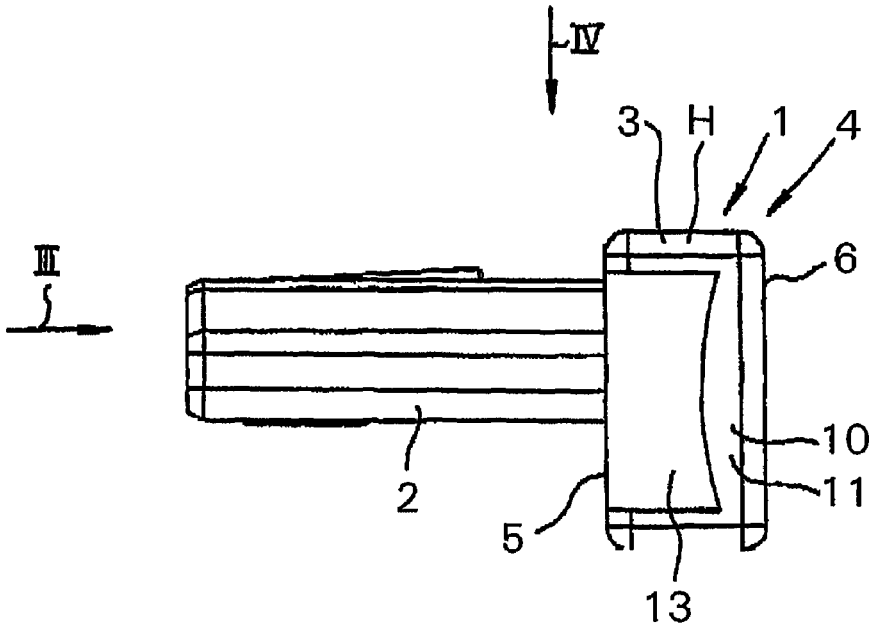
FIG. 1 shows a side view of an adapter according to the invention.
Figure 2:
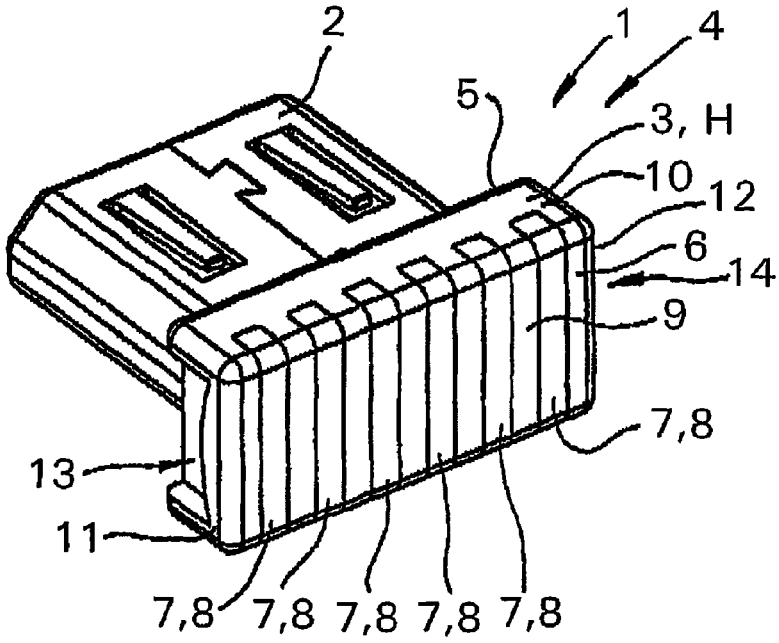
FIG. 2 shows a perspective view of the adapter shown in FIG. 1.
Figure 3:
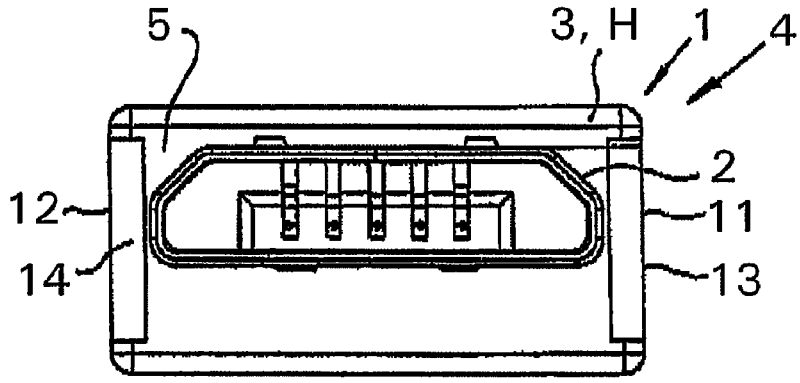
FIG. 3 shows a side view of the adapter shown in FIG. 1 from arrow direction III.
Figure 4:
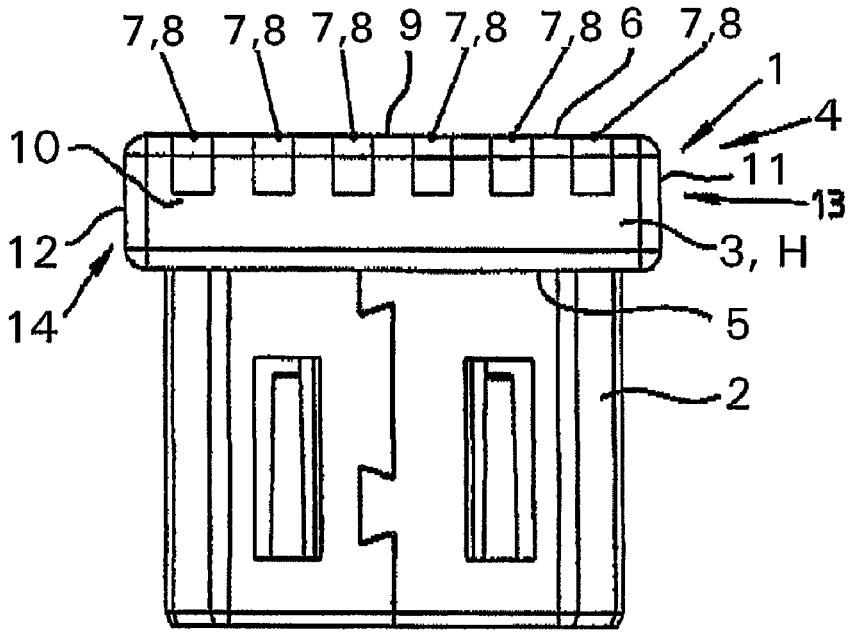
FIG. 4 shows a plan view of the adapter shown in FIG. 1 from arrow direction IV.

A side view of an adapter 1 according to the invention is illustrated in FIG. 1. Further views of the adapter 1 are shown in FIGS. 2 to 4, with the adapter 1 being illustrated in perspective view in FIG. 2, in side view from arrow direction III in FIG. 3, and in plan view from arrow direction IV in FIG. 4. The adapter 1 comprises a plug contact 2, which is designed as a micro USB plug contact or alternatively as a mini USB plug contact, and a contact body 3. The plug contact 2 and the contact body 3 are connected to one another to form an integral component 4 which forms the adapter 1. The contact body 3 faces, by way of an abutment face 5, the plug contact 2 and is similar to a hexahedron H. A contact face 6, which is opposite the abutment face 5 or the plug contact 2, of the adapter 1 has flat contacts 7 that are in the form of strips 8. The contact face 6 is substantially formed from the contacts 7 and the surface 9 of a dielectric 10, which surface is situated between the contacts 7. The adapter 1 or contact body 3 has, on opposite transverse side faces 11, 12, two opposite gripping recesses 13, 14 into which a user can insert, for example, a thumb nail and index finger nail in order to withdraw the adapter—as shown in an alternative embodiment in FIG. 6—from a socket 16 of a mobile device 17 which is designed as a mobile telephone 18. The adapter 15 shown in FIG. 6 is a schematically illustrated adapter.

Figure 5:
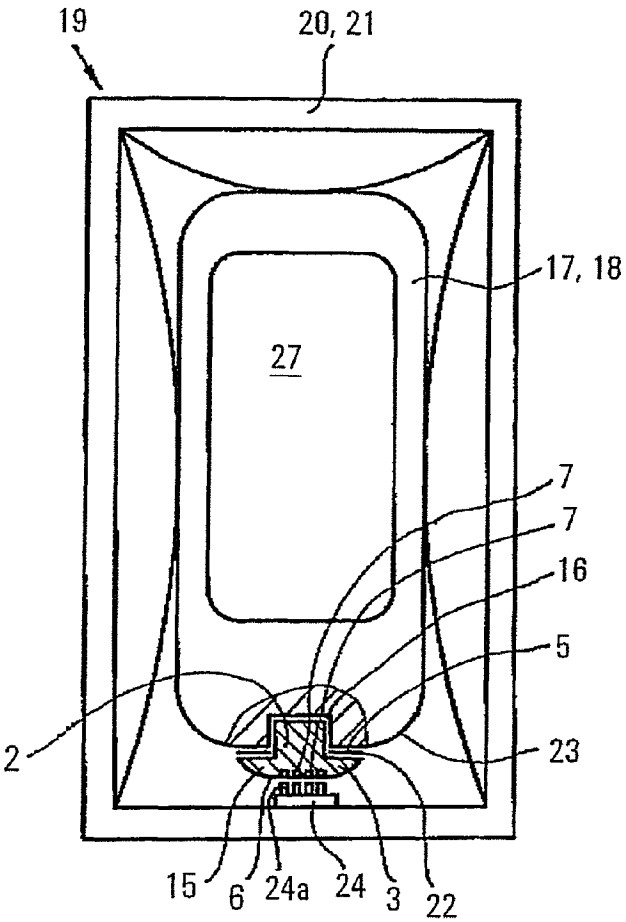
FIG. 5 shows a plan view of a schematic illustration of a first arrangement according to the invention.

FIG. 5 shows a plan view of a first embodiment of an arrangement 19 according to the invention. The arrangement 19 is schematically illustrated and comprises the abovementioned mobile device 17, which is in the form of a mobile telephone 18, the abovementioned adapter 15 and a mount 20 which is in the form of a motor vehicle mount 21. The adapter 15 comprises a disk-like sealing ring 22 which forms an abutment face 5 of a contact body 3 of the adapter 15. The contact body 3 rests against a surface 23 of the mobile device 17 by way of the sealing ring 22. As a result, a socket 16 of the mobile device 17, which socket is designed as a micro USB socket or alternatively as a mini USB socket, is protected against moisture and splashing. The adapter 17 is plugged into this socket 16 by way of plug contact 2. Opposite the abutment face 5, the adapter 15 has a contact face 6 with contacts 7. Contacts 24*a* of a contact strip 24 of the mount 20 make contact with the contacts 7, with the contacts 24*a* being in the form of pin-like, sprung contacts—so-called pogo pins. On account of the use of the adapter 15, it is not necessary for a sensitive and movable plug to make contact with the sensitive socket 16 of the mobile device 17. Instead, designs of mounts and contact-making means which have proven themselves millions of times in series production can be called on. Furthermore, the adapter 15 also stops the user from having to remove a protective cap from the socket of the mobile device before inserting the mobile device into the mount and from having to reinsert the protective cap into the socket of the mobile device after the mobile device is removed from the mount, since the adapter can remain permanently in the socket.

Figure 6:
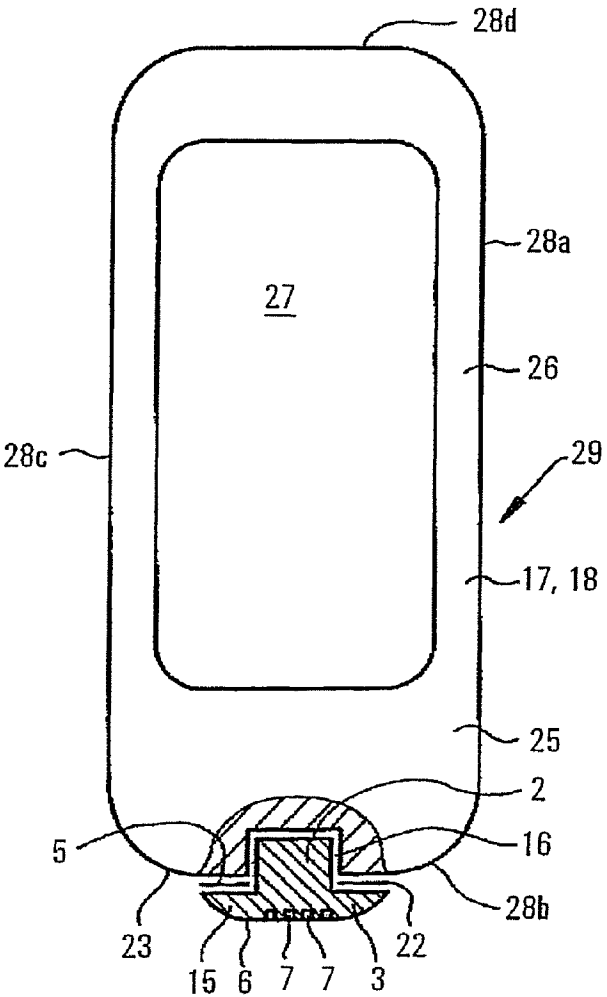
FIG. 6 shows a plan view of the mobile device with an adapter from the arrangement shown in FIG. 5.

The mobile device 17 which is removed from the mount 20 is illustrated in FIG. 6. According to the invention, the contact body 3 is matched to a shape of a housing 25 of the mobile device 17. The mobile device 17 has an upper face 26 with a display 27. The upper face 26 merges with a lower face 29, which is situated opposite the upper face 26, by way of four side faces 28*a*-28*d*.

Figure 7:
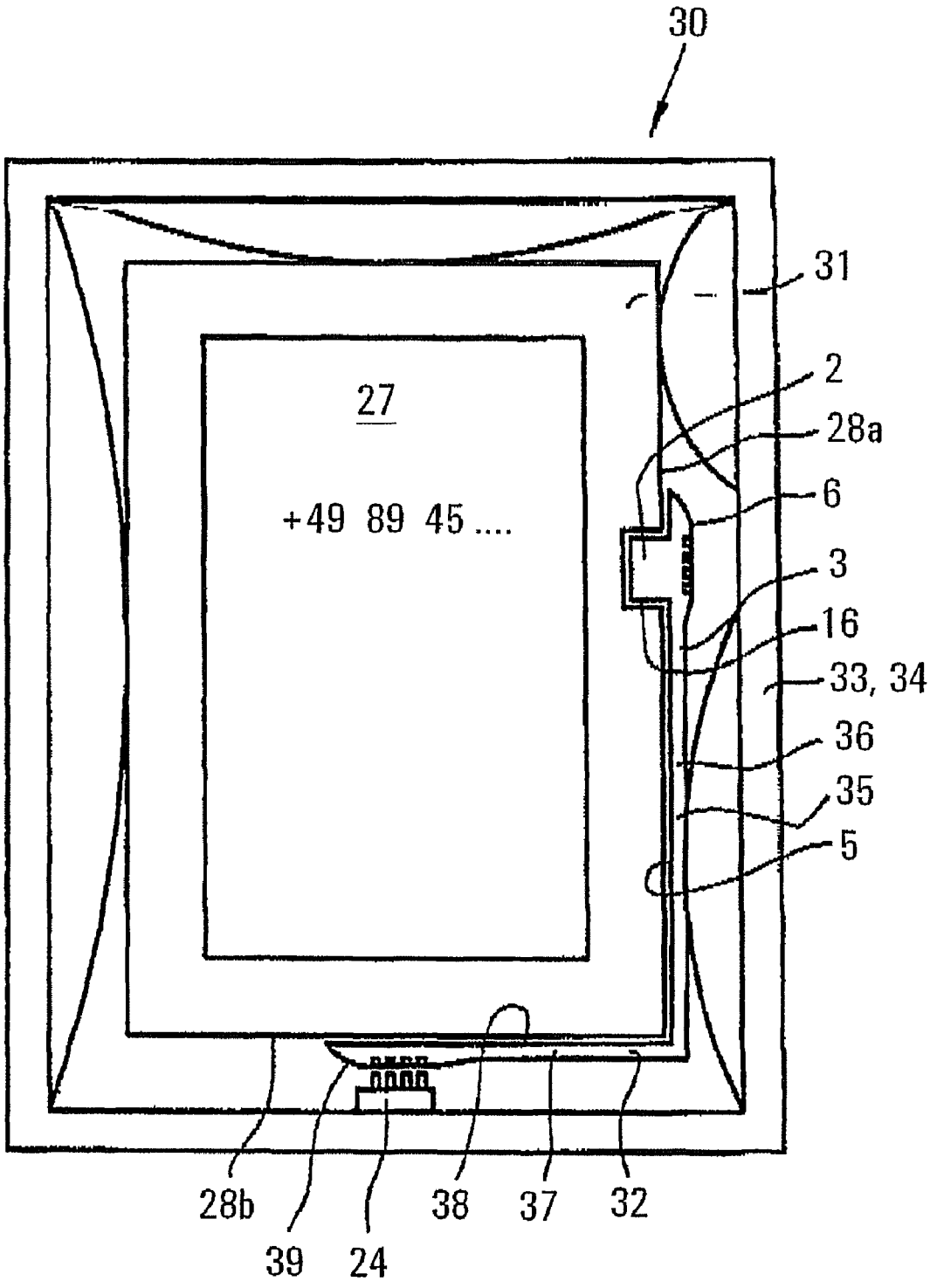
FIG. 7 shows a plan view of a schematic illustration of a second arrangement according to the invention.

FIG. 7 shows a plan view of a second embodiment of an arrangement 30 according to the invention. The arrangement 30 is schematically illustrated and comprises a mobile device 31, an adapter 32 and a mount 33 which is in the form of a motor vehicle mount 34. The adapter 32 essentially comprises a plug contact 2 and a contact body 3. The contact body 3 is in the form of an elbow 35 with two limbs 36, 37, with the limbs 36, 37 running along adjacent side faces 28*a* and 28*b* of the mobile device 31 and resting against side faces by way of abutment faces 5 and 38. The adapter 32 is plugged into a socket 16 by way of the plug contact 2. If the plug contact 2 is a micro USB plug, then the socket 16 would be designed as a micro USB socket. The adapter 32 has a first contact face 6 which is situated opposite the abutment face 5. Furthermore, the adapter 32 has a second contact face 39 which is situated opposite the second abutment face 38. An adapter 32 of this type is used, in particular, when the socket 16 is arranged to the right or left of a display 27 when the display 27 is correctly oriented in the mobile device 31, and when the mount 33 is, in particular, a motor vehicle mount 34. As a result, it is possible to arrange the contact strip 24 of the mount 33 above or below the display 27 which is oriented in the correct manner and such that it can be read; this has the advantage that, when installed in a motor vehicle, more installation space is generally available above and below the mobile device 31.

Figure 8:
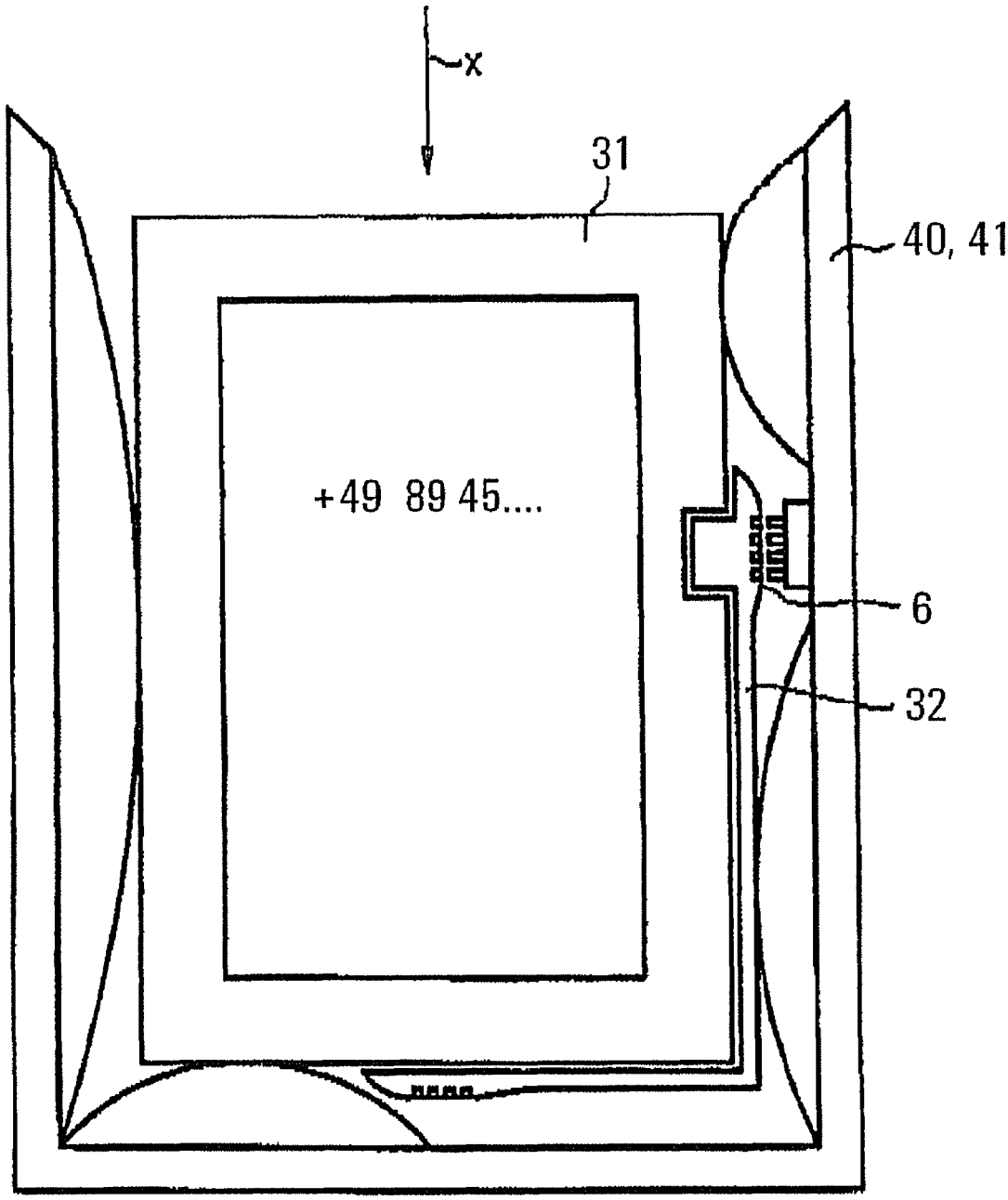
FIG. 8 shows a plan view of a schematic illustration of a third arrangement according to the invention.

FIG. 8 shows a further mount 40 for the mobile device 31 which is shown in FIG. 7, the mount being in the form of a charger 41. Since an adequate amount of installation space is also available at the sides here, contact is made from the side in the region of a first contact face 6 of the adapter 32 which is known from FIG. 7. Otherwise, reference is made to the description relating to FIG. 7 with regard to the adapter 32. In the case of the charger 41, the mobile device 31 is inserted into the charger 41 in arrow direction x.

Figure 9:
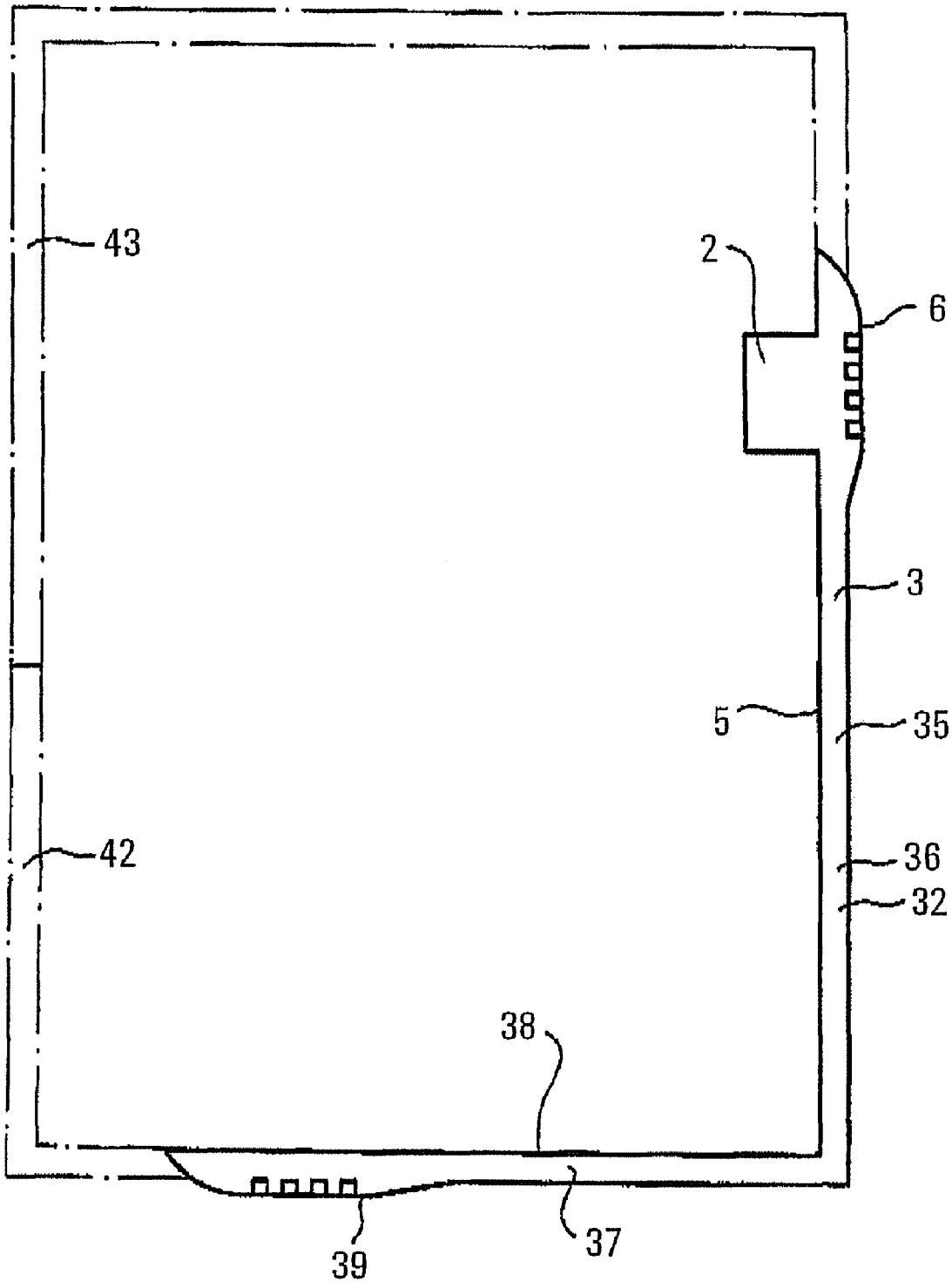
FIG. 9 shows a view of the adapter shown in FIGS. 7 and 8.

FIG. 9 shows the adapter 32 which is already known from FIGS. 7 and 8 on its own. In this case, reference is made to the corresponding portions of the description relating to FIGS. 7 and 8. The adapter 32 may possibly be intended to remain permanently in a mobile device. To this end, provision is made, according to the invention,—as illustrated by dashed and dash-dotted lines—for the contact body of the adapter to be of U-shaped design and to run along three side faces of the mobile device as a clip 42, or for the contact body of the adapter to surround the mobile device on all sides faces, which adjoin the upper face with the display, as a belt 43.

The invention is not restricted to illustrated or described exemplary embodiments. Instead, it comprises developments of the invention within the scope of the patent claims.

LIST OF THE REFERENCE NUMERALS

| | |
|---|---|
| 1 | Adapter |
| 2 | Plug contact of 1 |
| 3 | Contact body |
| 4 | Integral component |
| 5 | Abutment face of 3 |
| 6 | Contact face of 3 |
| 7 | Flat contact on 3 |
| 8 | Strip |
| 9 | Surface of 3 |
| 10 | Dielectric |
| 11 | Transverse face of 3 |
| 12 | Transverse face of 3 |
| 13 | First gripping recess |
| 14 | Second gripping recess |
| 15 | Further adapter |

-continued

| | |
|---|---|
| 16 | Socket |
| 17 | Mobile device |
| 18 | Mobile telephone |
| 19 | Arrangement |
| 20 | Mount |
| 21 | Motor vehicle mount |
| 22 | Sealing ring of 15 |
| 23 | Surface of 17 |
| 24 | Contact strip |
| 24a | Contacts of 20 and 21 |
| 25 | Housing of 17 |
| 26 | Upper face of 17 |
| 27 | Display on 26 of 17 |
| 28a - 28d | Side face of 17 |
| 29 | Lower face of 17 |
| 30 | Arrangement |
| 31 | Mobile device |
| 32 | Adapter |
| 33 | Mount |
| 34 | Motor vehicle mount |
| 35 | Elbow |
| 36 | Limb of 35 |
| 37 | Limb of 35 |
| 38 | Second abutment face |
| 39 | Second contact face |
| 40 | Mount |
| 41 | Charger |
| 42 | Clip |
| 43 | Belt |
| H | Hexahedron |
| x | Arrow direction |

I claim:

1. An adapter for a USB socket in a mobile device comprising a USB plug contact and a contact body connected to the USB plug contact, the contact body having a hexahedron shape comprising an abutment face, two transverse side faces, a first contact face, a second contact face and a third contact face, wherein the abutment face is a main face of the contact body and connects the USB plug contact to the contact body, the first contact face is a main face of the contact body that is directly opposite the abutment face, the two transverse side faces are opposing side faces of the contact body connecting the abutment face and the first contact face, and the second contact face and the third contact face are opposing faces of the contact body connecting the two transverse sides, the first contact face and the abutment face, wherein the first contact face, the second contact face and the third contact face are formed of a dielectric and include one or more flat contacts in the form of strips, each strip extending from the second contact face across the first contact face to the third contact face, and wherein the abutment face rests against a surface of the mobile device.

2. The adapter according to claim 1, wherein the contact body further comprises a gripping recess.

3. The adapter according to claim 1, wherein the contact body further comprises two gripping recesses which are arranged on opposite sides of the contact body.

4. The adapter according to claim 1, wherein the contact body is a covering cap which seals off the USB socket of the mobile device from a surrounding area.

5. The adapter according to claim 1, wherein the contact body is a cube.

6. An adapter for a USB socket in a mobile device comprising a USB plug contact and a contact body which is connected to the USB plug contact, the contact body comprising at least one abutment face for resting against a surface of the mobile device and at least one contact face with flat contacts, wherein the contact body further comprises two limbs joined in an L-shape, wherein the limbs extend along two adjacent side faces of the mobile device.

7. An arrangement comprising a mobile device with a socket for making contact, a mount and an adapter, the adapter comprises a plug contact and a contact body, wherein the contact body has a hexahedron shape comprising an abutment face, two transverse side faces, a first contact face, a second contact face and a third contact face, wherein the abutment face is a main face of the contact body and connects the USB plug contact to the contact body, the first contact face is a main face of the contact body that is directly opposite the abutment face, the two transverse side faces are opposing side faces of the contact body connecting the abutment face and the first contact face, and the second contact face and the third contact face are opposing faces of the contact body connecting the two transverse sides, the first contact face and the abutment face, wherein the first contact face, the second contact face and the third contact face are formed of a dielectric and include one or more flat contacts in the form of strips, each strip extending from the second contact face across the first contact face to the third contact face, wherein the abutment face rests against a surface of the mobile device, and wherein the contact body forms a covering cap for the socket that protects the socket when the mobile device is removed from the mount.

8. An arrangement according to claim 7, wherein the socket of the mobile device is one of a micro USB socket and a mini USB socket, and the plug contact of the adapter is one of a micro USB plug contact and a mini USB plug contact, respectively.

9. An arrangement according to claim 8, wherein the contact body further comprises a gripping recess.

10. An arrangement according to claim 8, wherein, the contact body further comprises two gripping recesses which are arranged on opposite sides of the contact body.

11. An arrangement according to claim 8, wherein the contact body is a covering cap which seals off the socket of the mobile device from a surrounding area.

12. An arrangement according to claim 8, wherein the contact body is a cube.

13. An arrangement comprising a mobile device with a socket for making contact, a mount and an adapter, wherein the adapter comprises a plug contact and a contact body which is connected to said plug contact, the contact body comprising at least one abutment face for resting against a surface of the mobile device and at least one contact face with flat contacts, wherein the contact body forms a covering cap for the socket that protects the socket when the mobile device is removed from the mount, wherein the socket of the mobile device is one of a micro USB socket and a mini USB socket, and the plug contact of the adapter is one of a micro USB plug contact and a mini USB plug contact, respectively, wherein the contact body further comprises two limbs joined in an L-shape, wherein the limbs extend along two adjacent side faces of the mobile device.

14. An adapter for a USB socket in a mobile device comprising a USB plug contact and a contact body connected to the USB plug contact, wherein the contact body is a hexahedron comprising an abutment face, two transverse side faces, a first contact face, a second contact face and a third contact face, wherein the abutment face is a main face of the contact body and connects the USB plug contact to the contact body, the first contact face is a main face of the contact body that directly opposes the abutment face, the two transverse side faces are opposing side faces of the contact body connecting the abutment face and the first contact face, and the second contact face and the third contact face are opposing faces of the contact body connecting the two transverse sides, the first contact face and the abutment face, wherein the first contact face, the second contact face and the third contact face are formed of a dielectric and include one or more flat contacts that are in the form of dots, and wherein the abutment face rests against a surface of the mobile device.

15. An arrangement comprising a mobile device with a socket for making contact, a mount and an adapter, the adapter comprises a plug contact and a contact body, wherein the contact body has a hexahedron shape comprising an abutment face, two transverse side faces, a first contact face, a second contact face and a third contact face, wherein the abutment face is a main face of the contact body and connects the USB plug contact to the contact body, the first contact face is a main face of the contact body that is directly opposite the abutment face, the two transverse side faces are opposing side faces of the contact body connecting the abutment face and the first contact face, and the second contact face and the third contact face are opposing faces of the contact body connecting the two transverse sides, the first contact face and the abutment face, wherein the first contact face, the second contact face and the third contact face are formed of a dielectric and include one or more flat contacts that are in the form of dots, wherein the abutment face rests against a surface of the mobile device, and wherein the contact body forms a covering cap for the socket that protects the socket when the mobile device is removed from the mount.

* * * * *